US005101844A

United States Patent [19]

Morrone

[11] Patent Number: 5,101,844

[45] Date of Patent: Apr. 7, 1992

[54] UMBRELLA SECURING AND TEARING PREVENTION DEVICE

[76] Inventor: James V. Morrone, 267 Shirley St., Winthrop, Mass. 02152

[21] Appl. No.: 500,198

[22] Filed: Mar. 27, 1990

[51] Int. Cl.[5] ..... A45B 25/18

[52] U.S. Cl. ..... 135/33.5

[58] Field of Search ..... 135/36 RT, 44, 48, 36 K

[56] References Cited

U.S. PATENT DOCUMENTS

| | | | |
|---|---|---|---|
| 198,621 | 12/1877 | Hurcombe | 135/36 RT |
| 404,039 | 5/1889 | Harris | 135/36 RT |
| 988,904 | 4/1911 | Sprague | 135/36 RT |
| 2,221,288 | 11/1940 | Okun | 135/25 X |
| 3,687,146 | 8/1972 | Seitel | 135/44 X |

FOREIGN PATENT DOCUMENTS

| | | | |
|---|---|---|---|
| 149466 | 12/1952 | Australia | 135/36 RT |
| 98773 | 8/1898 | Fed. Rep. of Germany | 135/36 RT |
| 2331 | of 1887 | United Kingdom | 135/36 RT |

*Primary Examiner*—John E. Murtagh
*Assistant Examiner*—Lan Mai
*Attorney, Agent, or Firm*—Herbert L. Gatewood

[57] ABSTRACT

A device for an umbrella and in particular a securing and tearing prevention device, that is attached to the umbrella rib ends and further attached to the umbrella material. Providing additional securing of the umbrella material to the umbrella rib ends outer perimeter.

Thus, keeping the umbrella material from breaking away from the rib ends and preventing tearing of the umbrella material.

8 Claims, 5 Drawing Sheets

UMBRELLA SECURING AND TEARING PREVENTION DEVICE

BACKGROUND AND SUMMARY OF THE INVENTION

The present invention relates in general to a device for additional securing or for securing the umbrella outer perimeter edge or edges. And for the prevention of the tearing of the umbrella material.

And further, for additional securing for an umbrella rib or ribs. And still further, to provide a handle for the umbrella that is adapted to receive such a device.

More particularly, the invention relates to the umbrella material located at the outer perimeter of the umbrella which is sewn to the umbrella ribs, at the ends thereof, said ribs, keeping and holding the outer perimeter of the umbrella material.

Further, said material keeping and holding said ribs from being displaced.

However, this has been found in many cases to be a weak point.

Therefore, it is the object of the present invention to provide an additional means to keep the edges of the outer perimeter of the umbrella material that is sewn to the rib or ribs, constant from breaking away from the ribs at the end or ends where they are sewn to the ribs.

Another object of the present invention is to overcome weakness found in the umbrella material edges at the outer perimeter thereof, by the means of securing of the umbrella material to the rib end or ends, and also to reduce the cost to the consumer having to replace the broken umbrella due to the tearing of the material and of the tearing of the thread which holds the material to the rib construction, after which also leads to the displacement and the bending of the umbrella rib or ribs.

Still another object of the present invention is to provide a handle for the umbrella, having a larger circumference at the top of the handle, and a smaller circumference at the bottom portion thereof.

The larger circumference for receiving the umbrella rib ends with the device attached thereto.

The smaller circumference, for the hand holding the umbrella.

To accomplish the foregoing and other objects, features and advantages of the invention, there is provided a small manufactured device, preferably made of plastic, but not limited to plastic.

This device is adapted to fit over the umbrella rib end or ribs ends, and further to be secured to the umbrella material. And more further, to be secured to the rib ends.

Another feature of the present invention is to provide a snap fitting means for the device, enabling the consumer to attach the device to the umbrella with relative ease. Another feature of the present invention is to provide a gripping means, located in the device which aides in holding the material to the device.

Still another feature of the present invention is to provide inner chambers in the device to fit the contour of the umbrella rib end or ribs ends.

Still another feature of the present invention is to provide an offsetting, contrasting color for the device, which will enhance the appearance of the umbrella. Still another feature of the present invention is to provide a handle for the umbrella which will receive the umbrella rib ends with the device attached thereto, while the umbrella is in the closed position thereof. Said rib end or ribs ends fitting inside the larger circumference portion of the handle.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
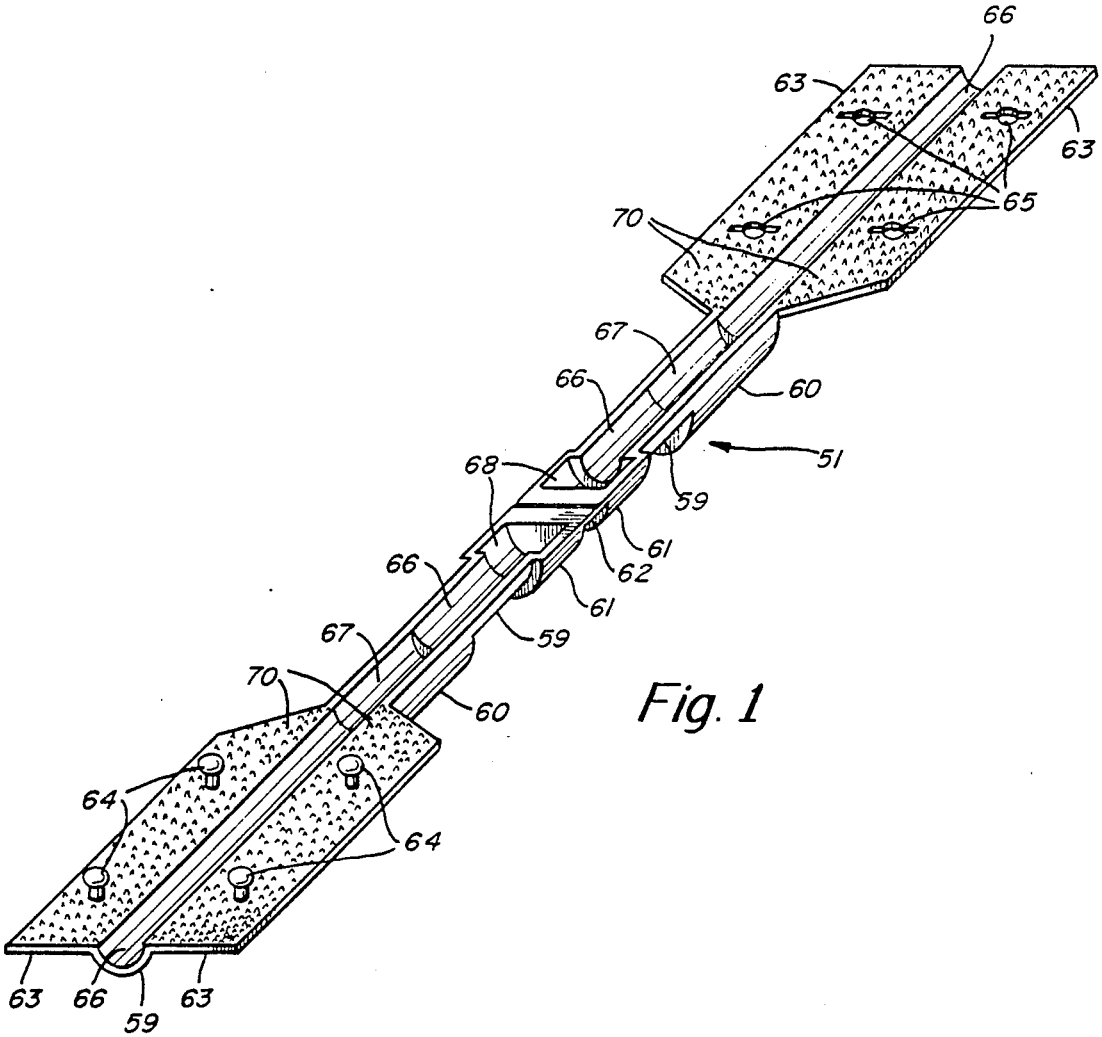
FIG. 1 is a perspective view of a particular intended design the umbrella device in the open position thereof.

Reference is now made to the drawings and in particular to FIG. 1 which shows the umbrella device 51 in the open position thereof, having winged or wing sections or wings 63 located at both ends of the device.

It is noted that the wing sections incorporate gripping means 70 located at both ends of the device.

Figure 10:
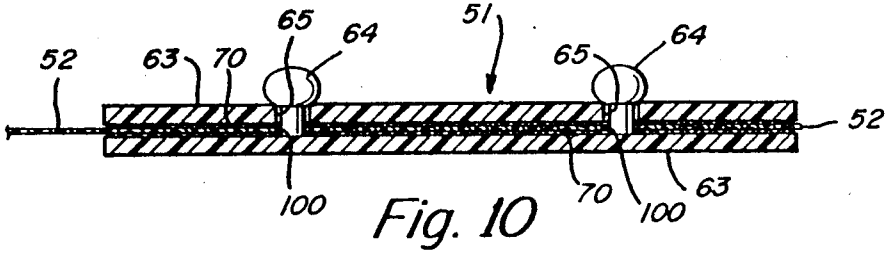
FIG. 10 is a cross-sectional side view of the umbrella device, taken along line 10—10 of the winged section of FIG. 2, and further illustrating a fragmentary view of the umbrella material entrapped between the closed wings of the umbrella device.

Said gripping means used to aid in holding the umbrella material fast, from slipping, after the wings are folded closed against the umbrella material, illustrated in FIG. 10.

To accomplish this there is provided a folding section 62 type hinge which allows the device to be folded, bringing the wings 63 together, forming a sandwich type arrangement with the umbrella material 52.

Pin-type means 64 are located on one end of the inner surfaces of the wings 63, and corresponding holes 65 are located on the opposite end of the device, in wings 63.

Said pin means 64 passing through the holes 100 in the umbrella material 52, illustrated in detail in FIG. 10. In this regard, refer to FIG. 10, also refer to FIG. 7. To accomplish this, the holes 65 in the winged section 63 are used as a guide when placed against the umbrella material 52 before the device 51 is folded closed.

Said guide providing a hole for said pin means 64 to pass through and make a hole 100 in the umbrella material 52, therefore allowing the pin means 64 to pass through the holes 100 of the umbrella material 52, illustrated in FIG. 10, and after which said pin means 64 pass through holes 65 located in wings 63, also shown in FIG. 10.

Figure 7:
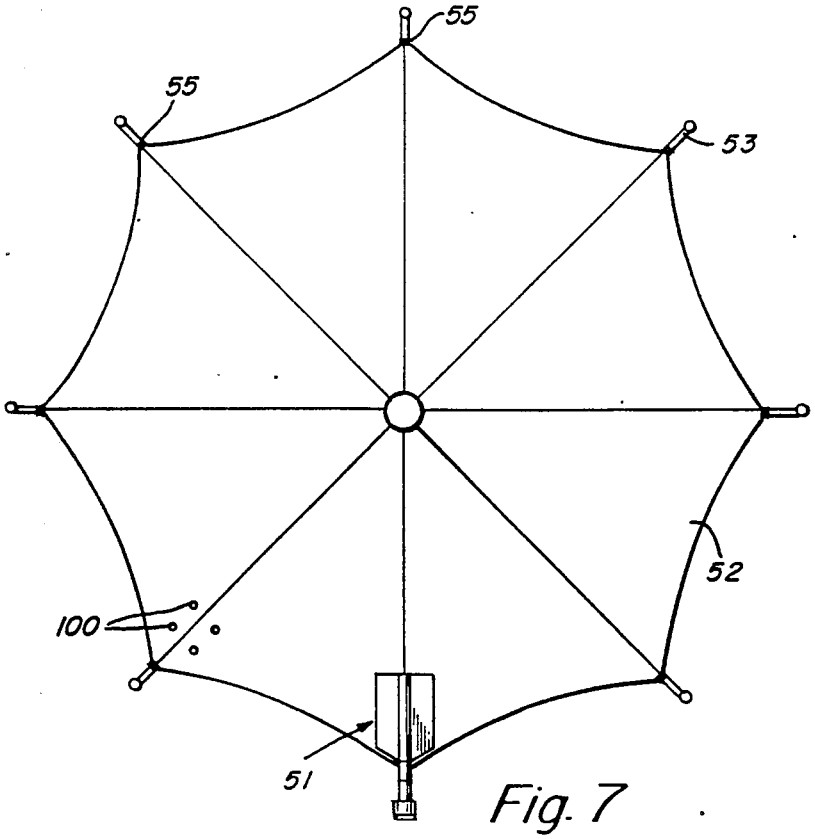
FIG. 7 is a top view of the umbrella, with the umbrella device attached thereto, and further illustrating the function of the umbrella device, being used for securing the umbrella material to the rib end and also showing pre-made holes in the umbrella material, which may or may not be pre-made.

Said holes 100 further shown in umbrella material 52 in FIG. 7.

It is further noted that the said pin means 64 is found having a holding feature which is used for keeping the winged sections 63 held fast, and secured together when the device is in the folded closed position, also illustrated in FIG. 10.

FIG. 1 further shows inner chambers in the device 51, located in the central section thereof, at 66 and 67 and 68, which form closed inner chambers in the device when the device is folded together.

Figure 11:
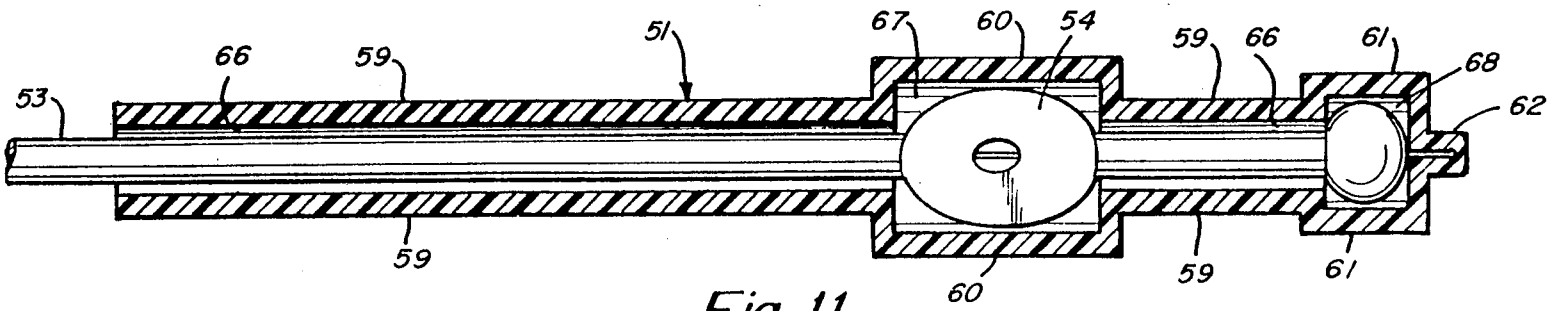
FIG. 11 is a cross-sectional side view of the umbrella device, taken along line 11—11 of the central inner chamber section of FIG. 2, and further illustrating a fragmentary view of the end rib construction enclosed in the inner chambers of the umbrella device.
Figure 12:
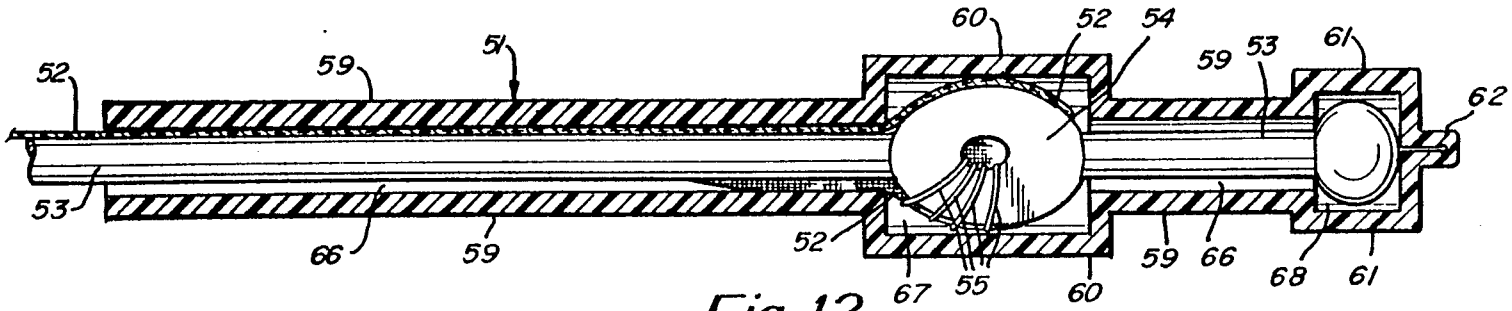
FIG. 12 is a cross-sectional side view of the umbrella device, taken along line 11—11 of the central inner chamber section of FIG. 2, and further illustrating a fragmentary view of an end rib construction enclosed in the inner chambers of the umbrella device, and more further illustrating a fragmentary view of the umbrella material attached to said end rib construction, also enclosed in the inner chambers of the umbrella device.

Said closed inner chambers used to house the rib ends at 53 and 54, shown in detail in FIGS. 11 and 12.

The inner chambers are constructed having outer walls.

The outer walls of inner chambers 66 are located at 59. The outer walls of inner chambers 67 are located at 60. And the outer walls of inner chambers 68 are located at 61.

FIG. 2

Figure 2:
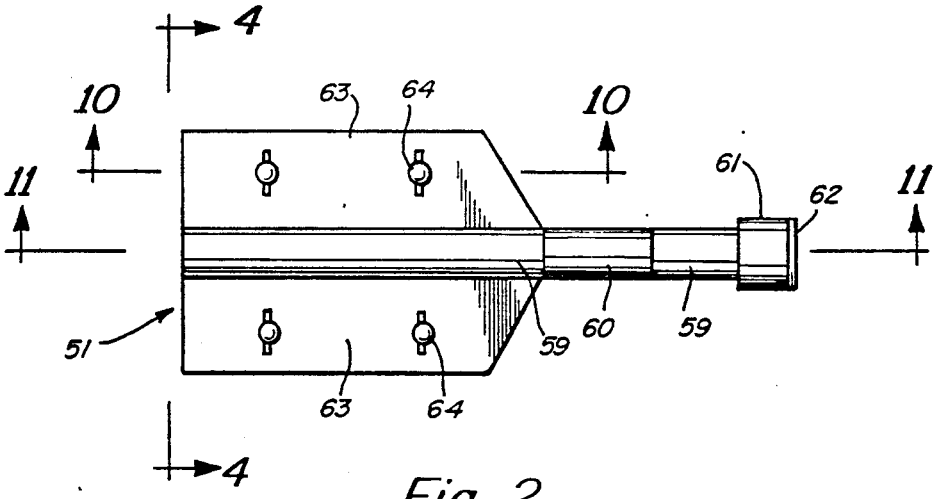
FIG. 2 is a top view of the umbrella device in the closed position thereof.

FIG. 2 shows the umbrella device 51 in the closed position thereof.

It is noted that this is a top view, showing lines 10—10, used for cross-sectional references of the winged section.

In this regard, refer to FIG. 10.

FIG. 2 also shows lines 11—11. Also used for cross-sectional references of the central inner chamber section of the device.

In this regard, refer to FIGS. 11 and 12.

Figure 4:
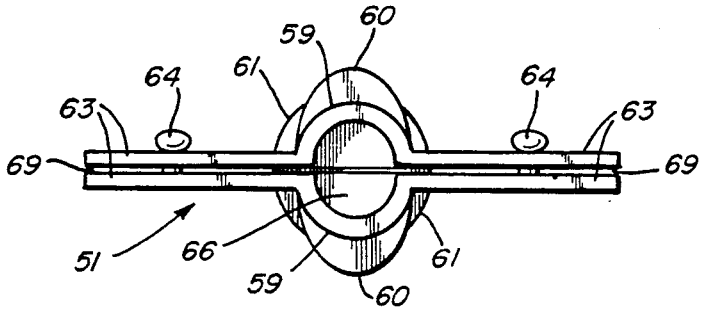
FIG. 4 is an end view of the umbrella device taken along line 4—4 of FIG. 2 in the closed position thereof.

FIG. 2 further shows lines 4—4, providing an end view of the device; also see FIG. 4.

The winged sections are given reference numbers 63.

Also, pin means 64, are shown holding the winged sections closed, and secured together.

Outer walls 59 of inner chambers 66, are indicated by said numbers 59.

Outer walls 60 of inner chambers 67 are indicated by said numbers 60.

Outer walls 61 of the inner chambers 68 are indicated by said number 61; also see FIG. 1.

Outer walls 59 and 60 are equal in diameter when viewed in FIG. 2, said figure showing a top view of the device.

Outer walls 61 are greater in diameter than outer walls 59 and 60 when viewed in FIG. 2.

Figure 9:
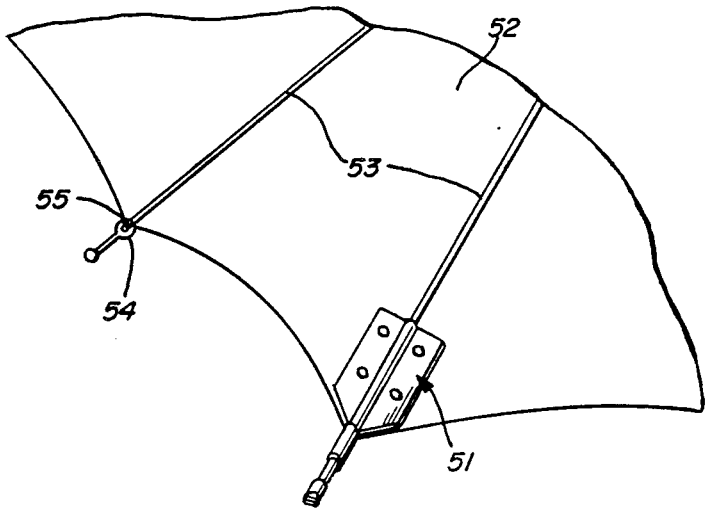
FIG. 9 is a fragmentary bottom view of the umbrella, showing the umbrella device attached thereto, and further showing the umbrella end rib construction, with the umbrella material attached thereto.

The greater diameter 61 for accommodating the ball type end of the umbrella rib, number 53, shown in FIG. 9; also see FIG. 7.

Hinge means 62 is equal in diameter to outer walls 61 when viewed in FIG. 2.

Said hinge means 62 allowing the device to be folded, bringing the winged sections 63 and the inner chamber sections 59, 60 and 61 together.

FIG. 3

Figure 3:
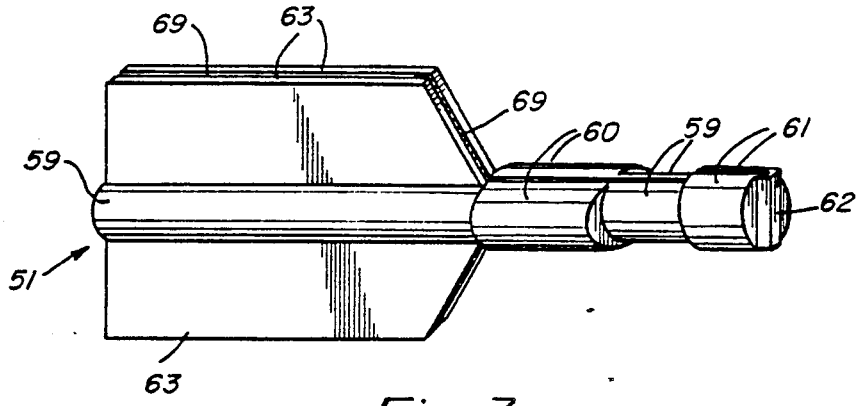
FIG. 3 is a perspective bottom view of the umbrella device in the closed position thereof.

FIG. 3 is a bottom perspective view of the umbrella device 51.

Again, it is noted that the winged sections are indicated by the number 63.

And the outer walls of the central inner chamber sections are indicated by the numbers 59, 60 and 61.

Outer walls 60 are greater in diameter than the outer walls 59 and 61 when viewed in FIG. 3.

Which shall be explained in further detail herein after. Hinge, means is given reference number 62.

Winged sections 63 also show the location 69 where the umbrella material is entrapped between the winged sections 63 when the device is attached to the umbrella rib end or ends 53, and the umbrella material 52. In this regard, refer to FIG. 7 and FIG. 9. Further details shown hereinafter.

FIG. 4

FIG. 4 is an enlarged end view of the umbrella device 51 taken along line 4—4 of FIG. 2.

Also, the gripping means 70 located on the inner sides of the winged sections 63 are not shown in FIG. 4, in order that more clarity may be expressed regarding reference number 69.

Said gripping means 70 are shown in FIG. 1 and in FIG. 10.

It is noted that the said reference number 69 shows the location where the umbrella material 52 is to be entrapped between said winged section 63.

In this regard, refer also to FIG. 10 and FIG. 7 and FIG. 9.

Pin means 64 pass through the winged sections 63.

And a holding feature, being a part of the pin means 64 keeps the winged sections 63 secured together when the device 51 is folded closed.

Figure 5:
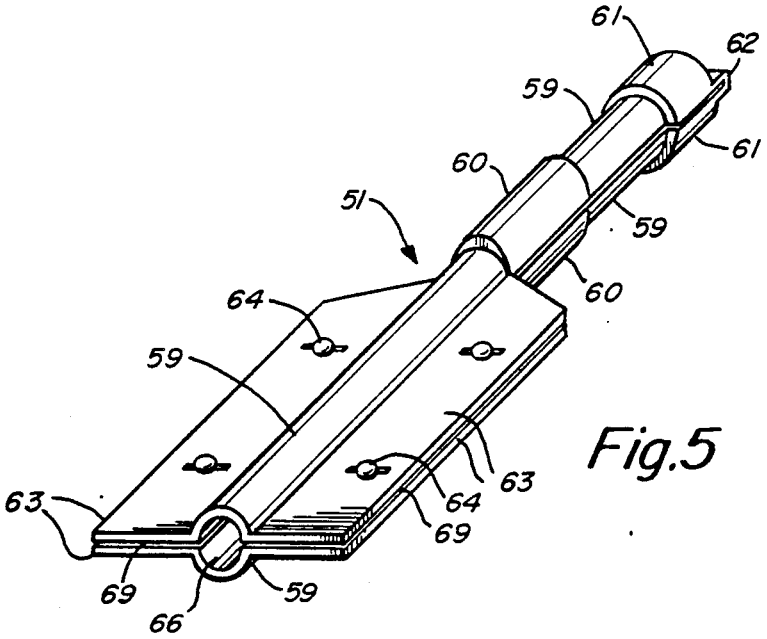
FIG. 5 is a perspective top view of the umbrella device in the closed position thereof.

Further illustrated in FIG. 10 and in FIG. 5 and in FIG. 9.

It is further noted that the said winged sections 63 extend outward, left and right in a horizontal path from the central inner chamber section 66 and its outer walls 59, 60 and 61.

In this regard, reference is now made to:

A—Outer walls 59 of the central inner chamber section 66 have a smaller circumference and a smaller diameter from top to bottom than outer walls 60 and 61.

B—Outer walls 60 have a larger diameter from top to bottom than outer walls 59 and 61.

C—Outer walls 61 have a larger circumference and a larger diameter than the outer walls 59.

Outer walls 61 have a smaller diameter from top to bottom than outer walls 60 have from top to bottom.

All of which shall be explained in further detail herein after.

In regard to A, B and C, refer to FIG. 5 and also FIGS. 11 and 12.

FIG. 5

FIG. 5 is a perspective top view of the umbrella device 51.

It is noted that the winged sections 63 are kept and secured together by the pin means 64 holding feature, when the umbrella device 51 is folded closed.

Said pin means 64 passing through the corresponding holes 65 located in the winged sections 63.

Said corresponding holes shown in FIG. 1.

It is further noted that reference number 69 again shows the location where the umbrella material 52 is entrapped between the said winged sections 63.

In this regard, refer also to FIG. 4 and FIG. 10.

Reference number 66 shows the inner chamber section where the end of the umbrella rib 53 is to be housed. In this regard, refer to FIGS. 11 and 12 and also FIG. 1.

Outer walls 59 of the inner chamber sections 66 are smaller in diameter from top to bottom than the diameter of the outer walls 60 and 61 from top to bottom.

In this regard, refer to FIG. 4.

More further, the said outer walls 60 forming an inner chamber section 67.

Said inner chamber section 67 shown in FIGS. 11 and 12. In this regard, refer to FIGS. 11 and 12 and also FIG. 1.

Further, said inner chamber section 67 used to house the rib section 54.

In this regard, refer also to FIGS. 11 and 12 and further to FIG. 9.

Also, it is noted in FIG. 5 that the hinge means is refered to by reference number 62.

FIG. 6

Figure 6:
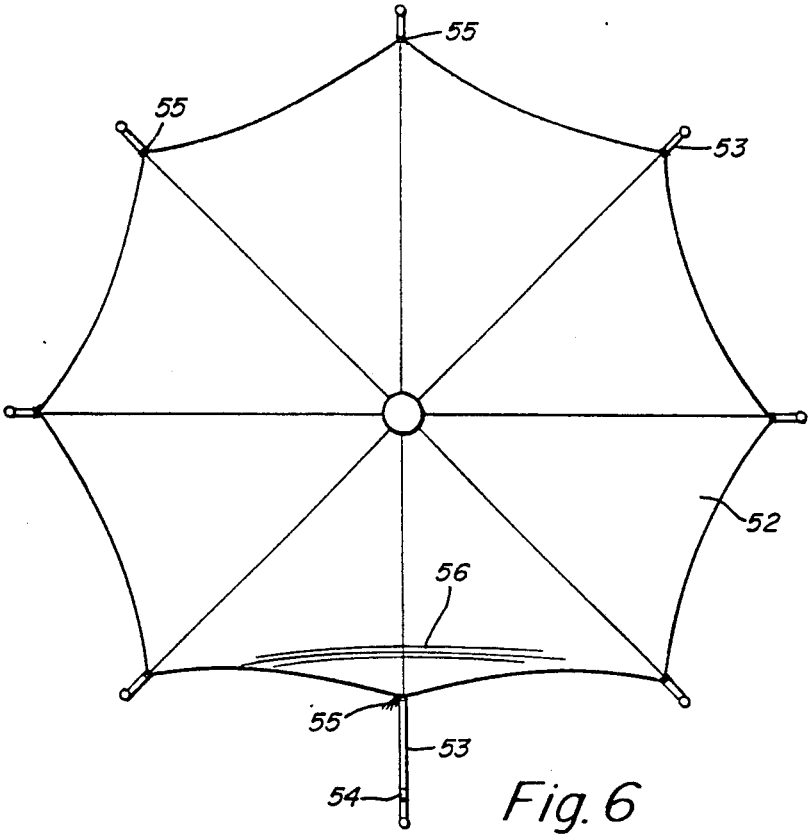
FIG. 6 is a top view of the umbrella, showing the umbrella material and the thread which holds the umbrella material to the rib construction, broken away from the rib ends.

FIG. 6 is a top view of the umbrella.

It is noted that the umbrella material is given reference number 52.

Figure 8:
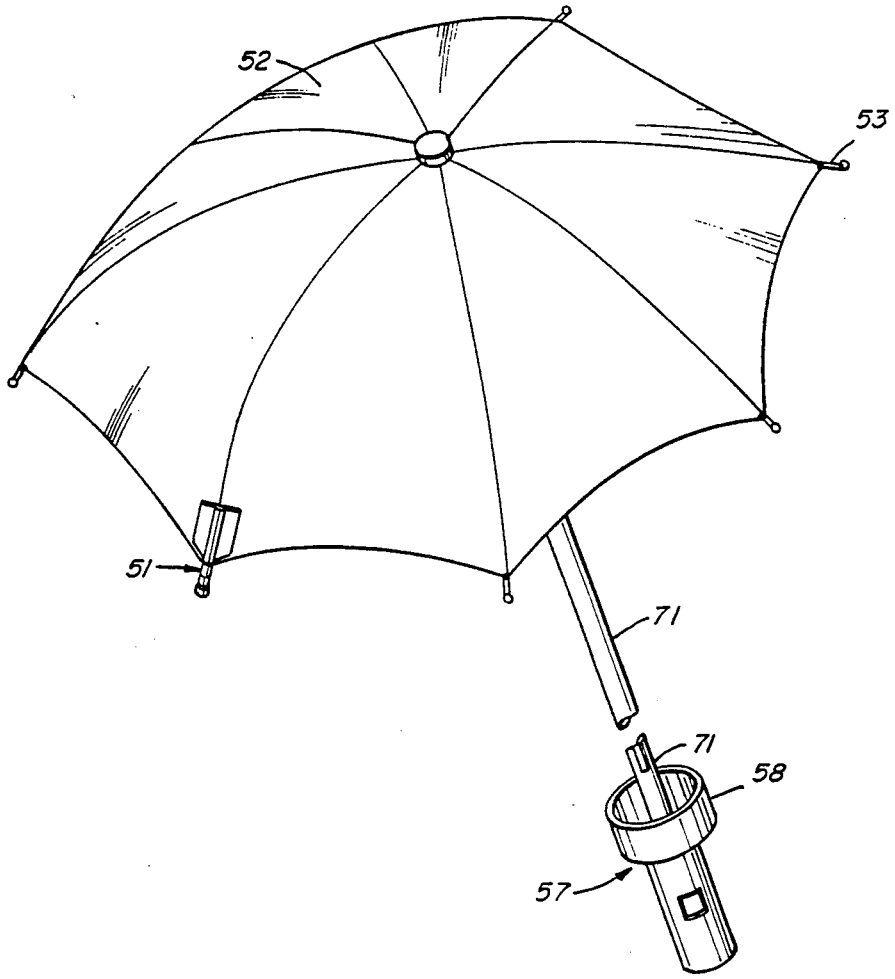
FIG. 8 is a perspective view of the umbrella, with the umbrella device attached thereto, and a fragmentary view of the umbrella tubing with a handle construction having two different diameter circumferences.

In this regard, refer also to FIG. 8 and to FIG. 10. The umbrella ribs are given reference number 53.

In this regard, refer to FIG. 9 and FIGS. 11 and 12. It is more further noted that reference number 54 indicates the rib section where the umbrella material 52 is sewn to the rib ends 53.

Illustrated in FIG. 9 and in FIGS. 11 and 12.

Reference number 55 shows the thread used in sewing the umbrella material 52 to the rib section 54.

In FIG. 6 the outer perimeter of the umbrella material 52 is sewn to the rib sections 54 located at the rib ends 53 with thread 55.

More further, it is illustrated that the thread 55 is broken away from one of the rib ends 53 where it was sewn to the rib section 54.

Again, further illustration of the umbrella material 52 held by the thread 55 sewn to rib section 54 shown in FIGS. 9 and 12.

In FIG. 6 that, where the thread 55 has broken away from rib section 54, it has an effect on the umbrella material 52.

Causing said material 52 to be pulled inward toward the central portion of the umbrella.

More further, causing the umbrella material 52 to be bunched up 56.

FIG. 7

FIG. 7 is a top view of the umbrella.

Umbrella device 51 is attached to the umbrella material 52 and is further attached to the rib end 53 52.

Also, it is noted that the thread 55 which holds the umbrella material 52 to the rib ends 53 is indicated by the number 55.

Further, it is noted that the device 51 now being attached to the umbrella, provides securing of the umbrella material 52 to the rib end 53.

Thus, the outer perimeter of the umbrella material 52 is held to the rib end 53.

FIG. 8

FIG. 8 is a perspective view of the umbrella and a fragmentary view of the umbrella tubing 71 with a umbrella handle 57 having a larger circumference 58 at the top of the handle.

Said handle adapted to receive the umbrella rib ends 53 with the device 51 attached thereto, while the umbrella is in the closed position thereof.

Said rib ends 53 adapted to fit inside of said larger circumference 58 portion of the handle 57.

Said handle 57 also having a smaller circumference portion for a persons hand.

Again, it is noted that the umbrella device 51 is attached to the umbrella material 52 and is further attached to the rib end 53 which holds the umbrella material 52. In this regard, refer also to FIG. 9 and FIG. 7.

FIG. 9

FIG. 9 is a fragmentary bottom view of the umbrella showing the ribs 53 and the umbrella material 52 with the umbrella device 51 attached to said rib 53 and also attached to said umbrella material 52.

It is further noted that the pin means 64 portion of the device 51 which snap fits the device 51 together is located on the under side, or what may be refered to as the bottom side of the umbrella.

In this regard, refer to FIG. 8 and FIG. 7 where the opposite side of the device 51 is shown located on the top side of the umbrella.

The thread 55 which holds the umbrella material 52 to the rib section 54 is sewn to said rib section 54.

In this regard, refer also to FIG. 12, FIG. 6 and FIG. 7.

FIG. 10

FIG. 10 is an enlarged cross-sectional side view of the winged sections 63 of the umbrella device 51 taken along line 10—10 of FIG. 2.

In this regard, refer to FIG. 2.

FIG. 10 also shows a fragmentary side view of the umbrella material 52.

Winged sections 63 are shown with the pin means 64 facing upward, instead of the downward position shown in previous FIGS. 7 and 8.

In FIG. 10 the said pin means 64 holding feature keeps and secures the winged sections 63 together when the device 51 is folded closed.

Umbrella material 52 is shown entrapped between said winged sections 63 in a sandwich type arrangement.

In this regard, refer also to FIGS. 7 and 9.

And it is noted in FIG. 10, the gripping means 70 aids in keeping and holding the umbrella material 52. Said gripping means 70 being pressed against the said umbrella material 52.

Also, it is noted that the pin means 64 pass through the winged section 63 corresponding holes 65.

Said corresponding holes 65 further illustrated in FIG. 1.

FIG. 11

FIG. 11 is a cross-sectional side view of the umbrella device 51 taken along line 11—11 of FIG. 2 in the folded closed position thereof.

FIG. 11 also shows a fragmentary side view of the umbrella rib 53.

It is noted that FIG. 11 illustrates the central inner chamber sections 66, 67 and 68.

Having outer walls 59, 60 and 61.

Said central inner chamber sections 66, 67 and 68 housing the rib 53 end portion which includes rib section 54. Said rib section 54 used for the sewing of the umbrella material 52 to the said rib section 54.

Said rib sections 54 holding the outer perimeter of the umbrella material 52.

In this regard, refer to FIG. 12 and FIG. 9.

In FIG. 11, the outer walls 59 have the least of three different diameters in comparison to the remaining outer walls 61 and 60.

Outer walls 61 being second largest in diameter. And outer walls 60 being the largest of the said three different diameters.

The hinge means is given reference number 62.

FIG. 11 is an enlarged view.

FIG. 12

FIG. 12 is a cross-sectional side view of the umbrella device 51 taken along line 11—11 of FIG. 2 in the folded closed position thereof.

FIG. 12 also shows a fragmentary side view of an umbrella rib 53.

And FIG. 12 further shows a fragmentary side view of the umbrella material 52.

FIG. 12 illustrates said said umbrella material 52 formed to the rib 53 and sewn to rib section 54 with thread 55.

And in this regard, refer to FIG. 9.

FIG. 12 illustrates the central inner chamber sections 66, 67 and 68. Having outer walls 59, 60 and 61.

Said central inner chamber sections 66, 67 and 68 housing the rib 53 end portion which includes rib section 54 and further includes the partial housing of the umbrella material 52 outer perimeter which is formed to rib 53 and sewn to rib section 54.

Said rib section 54 holding the outer perimeter of the umbrella material 52.

FIG. 12 is an enlarged view.

It is again noted that the outer walls 59 have the least of three different diameters in comparison to the remaining outer walls 61 and 60.

Said outer walls 61 being second largest in diameter. And outer walls 60 being the largest of the said three different diameters.

It is further noted that the hinge means is given reference number 62.

And more further, it is noted that the ball type end of rib 53 is also housed in said inner chamber 68.

What is claimed is:

1. A folding device in the open position having two end sections for an umbrella comprising umbrella material defined by an outer perimeter edge and having a plurality of ribs each having a top and bottom side for keeping and holding the outer perimeter of the umbrella material, said device having an opened and closed position and comprising two winged sections each defining a half section of the device, one of which is located at one end of the device and the other of which is located at the opposite end of the device, hinge means connecting together the winged sections, and inner chamber sections, said winged sections having an outer end and an inner end and being adapted to grip and hold a sizeable portion of the umbrella material located directly adjacent the umbrella rib at each end and on each side of said rib, said winged sections aiding in holding the umbrella material fast to said rib, said hinge means allowing opening and closing of the device, said device in use being capable of being folded to the closed position over and adjacent the rib end, and opened to the open position for removal and re-use again, said inner chamber sections adapted to fit said rib end, forming unbroken and closed inner chambers throughout its entirety, commencing at the hinge means located at the end of said rib and terminating at the opposite end of the device, said inner chambers leaving no portion of said rib end exposed throughout the length of said device, said inner chamber sections surrounding and housing that entire portion of the rib end causing holding of the umbrella material to the umbrella rib, the inner chambers pressing against umbrella material which overlays and comes in contact with that said rib at the top side thereof, said inner chambers bringing a pressure into existence against the rib, the material, and the inner chambers, said pressure commencing at a larger inner chamber, and ending at a smaller inner chamber, said smaller inner chamber being located most inward of a rib end, said larger inner chamber surrounding that portion of rib end which provides an eyelet for fastening umbrella material thereto, said inner chambers conforming to that said portion of the umbrella rib end, said device having two end sections while in the open position, comprising winged sections located at both ends, said winged sections having integral pin means located at one end, and corresponding holes for receiving said pin means located in winged sections at the opposite end, said pin means having an integral holding feature used for securing said device together while device is being attached to the umbrella rib end, the device being folded to the closed position, said attachment and securing being simultaneous, said pin means also interlocking said umbrella material within said device, said winged sections permitting the outer perimeter edge of the engaged umbrella material to be free from entrapment, after the device has been attached to the umbrella, at said rib end, said device being made of a singular construction, comprising two half sections, while device is in the open position, said two sections consisting of one half of the device being located in one section, and the other half of the device being located in the opposite section, said one half of device partly comprising half of the said inner chamber sections, and said opposite half of the device partly comprising the other half of said inner chamber sections, said halves, inner chamber sections being identical, forming full inner chamber sections surrounding said rib end, the device being attached thereto, folded to the closed position, said device being manufactured of a singular construction, so as to not be industry oriented, but instead to be consumer oriented, allowing easy attachment installation of device by consumer to said umbrella rib end, while also allowing the consumer easy removal of the device for re-use again, said singular construction allowing said winged sections, pin means, and inner chamber section to engage said umbrella material, and said umbrella rib end simultaneously, allowing said easy attachment and also allowing easy aforesaid securing o the device simultaneously, the securing of the device concluding with the attachment, this being accomplished in an aforesaid manner.

2. A folding device for an umbrella as set forth in claim 1, wherein said winged sections form a sandwich type arrangement with said umbrella material, said winged sections further comprising integral gripping means, used for gripping said umbrella material between the winged sections, said gripping occurring simultaneously as device is being attached to said umbrella rib end, said gripping concluding with completion and securing of said attachment of device to said umbrella rib end.

3. A folding device for an umbrella as set forth in claim 2, wherein said winged sections have substantially equal outer edge dimensions.

4. A folding device for an umbrella as set forth in claim 1, wherein said winged sections have substantially equal outer edge dimensions.

5. A device for an umbrella comprising umbrella material having a top side and an underside and being defined by an outer perimeter and a plurality of ribs each being defined by an outer end supporting the underside of the said material and keeping and holding the outer perimeter of the umbrella material on the end of the rib including means for closing and re-opening said device to an open position, and wherein construction of the device includes all members being integral, said device being made of a singular construction, comprising winged sections having pin means, and further comprising winged sections having holes therein for receiving such pin means, said device further comprising hinge means for connecting together the winged sections defining one end of the device and an opposite end and allowing the device to be opened to an open position and closed to a closed position, and inner chamber sections having different inside dimensions, said winged sections adapted to grip and hold a sizeable portion of the umbrella material directly adjacent a rib end and on each side thereof, said winged sections aid in holding the umbrella material fast to said rib, said hinge means allowing folding of the device to the closed position over the rib end, located at the outer perimeter of the umbrella, and further allowing re-opening of the device to the open position for removal and re-use again, said hinge means more further allowing said winged sections to fold over and under the said umbrella material directly adjacent the umbrella rib, entrapping the material between the winged sections, said rib end being located at said outer perimeter of the umbrella and defining an eyelet whereby the umbrella material can be secured to the rib end, said folding of the device over the rib end accomplished by holding one side of the device against said umbrella rib, which is located at the underside of the umbrella material, at said outer perimeter, and folding the opposite end of the device over the umbrella material which overlays and comes in contact with said rib at the top side of the umbrella material, also entrapping the material and underlying rib within said device's inner chamber sections, said inner chamber sections comprising, a larger inner chamber for surrounding that the rib end which is provided with said eyelet for fastening the umbrella material thereto, and a smaller inner chamber for surrounding a portion of the rib commencing at said eyelet, inward direction, said inner chambers conforming to that said portion of the umbrella rib end, said pin means comprising of an integral holding feature, used for securing said device together while device is being attached to said umbrella rib end, device being folded to the closed position, said attachment and securing being simultaneous, said pin means also interlocking said umbrella material within said device, said winged sections permitting the outer perimeter edge of the engaged umbrella material to be free from entrapment, after the device has been attached to the umbrella, at said rib end, said device being comprised of two half sections while in the open position, said two sections consisting of one half of device being located in one section, and the other half of device being located in the opposite section, said device having two end sections, also while in the open position, comprising winged sections located at both ends, said device being manufactured of a singular construction, so as to not be industry oriented, but instead to be oriented for use by a user, allowing easy attachment installation of device by said user to said umbrella rib end, while also allowing the user easy removal of the device for re-use again, said singular construction allowing said winged sections, pin means, and inner chamber sections of the device to engage said umbrella material, and said umbrella rib end simultaneously on being closed whereby allowing said easy attachment and also allowing easy aforesaid securing of the device simultaneously, the securing of the device to the umbrella material and rib end being concluded with the attachment, this being accomplished in an aforesaid manner.

6. A device for an umbrella as set forth in claim 5, wherein said winged sections form a sandwich type arrangement with said umbrella material, said winged sections further comprising integral gripping means, used for gripping said umbrella material between the winged sections, said gripping occurring simultaneously as device is being attached to said umbrella rib end, said gripping concluding with completion and securing of said attachment of device to said umbrella rib end.

7. A device for an umbrella as set forth in claim 6, wherein said winged sections have substantially equal outer edge dimensions.

8. A device for an umbrella as set forth in claim 5, wherein said winged sections have substantially equal outer edge dimensions.

* * * * *